US007631526B2

(12) United States Patent
Squier

(10) Patent No.: US 7,631,526 B2
(45) **Date of Patent: *Dec. 15, 2009**

(54) ENCLOSURE HAVING EXCHANGABLE LOCK ASSEMBLY

(76) Inventor: Randy L. Squier, 1333 Highland Rd., Stillwater, MN (US) 55082

( * ) Notice: Subject to any disclaimer, the term of this patent is extended or adjusted under 35 U.S.C. 154(b) by 0 days.

This patent is subject to a terminal disclaimer.

(21) Appl. No.: 12/059,626

(22) Filed: Mar. 31, 2008

(65) Prior Publication Data

US 2008/0180005 A1 Jul. 31, 2008

Related U.S. Application Data

(63) Continuation of application No. 10/393,615, filed on Mar. 21, 2003, now Pat. No. 7,363,789, which is a continuation-in-part of application No. 10/256,541, filed on Sep. 26, 2002, now Pat. No. 6,722,170.

(60) Provisional application No. 60/325,431, filed on Sep. 26, 2001.

(51) Int. Cl.
*E05B 49/00* (2006.01)

(52) U.S. Cl. ..... 70/278.1; 70/466; 70/443; 292/DIG. 53; 292/DIG. 64; 312/223.2

(58) Field of Classification Search ..... 70/278.1, 70/279.1, 443, 451, 461, 466, 370, 417, 32–34, 70/78, 79, 81; 292/DIG. 53, DIG. 64; 312/223.1, 312/223.2; 403/256–259, 373, 335–337, 403/408.1, 230
See application file for complete search history.

(56) References Cited

U.S. PATENT DOCUMENTS 1,046,127 A 12/1912 Weatherwax
3,236,342 A 2/1966 Persson
3,623,757 A 11/1971 Schlage
3,674,246 A 7/1972 Feeman
4,052,094 A 10/1977 Widén
4,074,552 A 2/1978 Smith
4,456,290 A 6/1984 Gross et al.
4,688,409 A 8/1987 Oliver et al.
4,708,007 A 11/1987 Stoia
4,887,856 A 12/1989 Percoco et al.
4,936,122 A 6/1990 Osada
4,967,305 A 10/1990 Murrer et al.
5,033,282 A 7/1991 Gartner et al.
5,113,675 A 5/1992 Uyeda
5,267,461 A 12/1993 Eizen
5,457,934 A 10/1995 Lehtola (Continued)

OTHER PUBLICATIONS

Sargent & Greenleaf Premium Security Locks Catalog, Jun. 13, 2001.

*Primary Examiner*—Suzanne D Barrett
(74) *Attorney, Agent, or Firm*—Moore & Hansen, PLLP

(57) ABSTRACT

An enclosure suitable for housing equipment for which controlled access is desirable. The enclosure has at least one, preferably two, enclosure doors secured by securing assemblies selected from a group consisting of a lock cylinder assembly, an electronic lock assembly, a quarter-turn latch assembly, a compression latch assembly, a folding T latch assembly, a lift and turn compression latch assembly, a pawl/cam action latch assembly, a multi-point latch assembly and a bolt assembly for securing to a rotary latch. Each securing assembly is secured to a mounting plate so that the respective securing assemblies may be easily exchanged within a standardized opening in the respective enclosure doors.

18 Claims, 12 Drawing Sheets

U.S. PATENT DOCUMENTS

| | | | | |
|---|---|---|---|---|
| 5,473,922 | A | 12/1995 | Bair et al. | |
| D366,201 | S | 1/1996 | Saini et al. | |
| 5,488,358 | A | 1/1996 | Hamilton et al. | |
| 5,488,660 | A | 1/1996 | Dawson et al. | |
| 5,493,279 | A | 2/1996 | Dawson et al. | |
| 5,709,114 | A | 1/1998 | Dawson et al. | |
| 5,787,741 | A | 8/1998 | Shen | |
| 5,841,347 | A | 11/1998 | Kim | |
| 5,841,361 | A | 11/1998 | Hoffman | |
| 5,893,283 | A | 4/1999 | Evans et al. | |
| 5,941,654 | A | 8/1999 | Chauquet | |
| 6,098,433 | A | 8/2000 | Maniaci | |
| 6,298,699 | B1 | 10/2001 | Gartner et al. | |
| 6,469,247 | B1 | 10/2002 | Dodds et al. | |
| 6,722,170 | B2 | 4/2004 | Squier | |
| 7,024,896 | B2 | 4/2006 | Squier | |
| 7,225,650 | B2 * | 6/2007 | Squier | 70/278.1 |
| 7,363,789 | B2 * | 4/2008 | Squier | 70/278.1 |

* cited by examiner

ENCLOSURE HAVING EXCHANGABLE LOCK ASSEMBLY

RELATED APPLICATIONS

The present application is a Continuation of allowed U.S. patent application Ser. No. 10/393,615 entitled COMPUTER NETWORK EQUIPMENT ENCLOSURE HAVING EXCHANGEABLE SECURING MECHANISMS filed Mar. 21, 2003, which is a continuation-in-part of U.S. patent application Ser. No. 10/256,541 entitled LOCK ASSEMBLY HAVING SECURE ENGAGEMENT PLATE filed Sep. 26, 2002, now issued as U.S. Pat. No. 6,722,170, which claims priority to U.S. Provisional Patent Application Ser. No. 60/325,431 entitled LOCK ASSEMBLY HAVING SECURE ENGAGEMENT PLATE filed Sep. 26, 2001, the disclosures of which are herein incorporated by reference. A series of two related applications claiming priority to U.S. patent application Ser. No. 10/256,541, mentioned above, include a first Continuation, U.S. patent application Ser. No. 10/827,490, entitled LOCK ASSEMBLY HAVING SECURE ENGAGEMENT PLATE, filed Apr. 19, 2004, now issued as U.S. Pat. No. 7,024,896, and a further Continuation, U.S. patent application Ser. No. 11/284,512, entitled LOCK ASSEMBLY HAVING SECURE ENGAGEMENT PLATE, filed Nov. 22, 2005, now issued as U.S. Pat. No 7,225,650.

FIELD OF THE INVENTION

The present invention provides computer network equipment enclosures having a lock assembly including a mounting plate for securing the lock assembly to an enclosure door. The lock assembly is easily changed out by the owner when security needs require a different type of lock assembly. In preferred embodiments, the lock assembly includes components of an electronic lock, preferably including a Dallas™ chip, which enables the lock to monitor entry into the computer enclosure. The present invention also includes a plurality of gangable enclosures, linked together. In alternate embodiments, the enclosures can be co-location units, which may also be ganged together.

BACKGROUND OF THE INVENTION

Locks to limit access to enclosures are well known in the art as are locks which monitor access to enclosures. Such locks are manufactured by a number of companies, most prominently Sargent & Greenleaf Lock Manufacturer's, Inc., Nicholasville, Ky.; LaGard, Inc., Torrance, Calif. and Kaba Mas, Inc. of Lexington, Ky. These locks can limit access to the inside of an enclosure to individuals who have a specific entry code which they are required to enter when seeking access to the enclosure. The locks can also monitor and keep a record of which codes are used to obtain access to the enclosure and when such access is obtained. These types of locks are well known in the art.

Unfortunately, from time to time the lock may need to be serviced or the owner of an enclosure may wish to upgrade from one lock to another. The installation of such a lock is time consuming and often requires an owner to request service from an outside service provider. In addition, original equipment manufacturers (OEM's) are also generally looking to simplify installation so that costs for labor can be reduced, thereby reducing the overall cost to the consumer of using the OEM's lock.

In the Detailed Description of this application, a description is provided of an AUDITCON™ lock made by Kaba Mas, Inc., Lexington, Ky. The preferred embodiment of the present invention may include such a lock or such other lock that would provide similar security features.

In the past, Mas-Hamilton and other lock manufacturers have provided their locks to manufacturers of enclosures, preferably enclosures used to enclose banking equipment, computer servers and other sensitive electronic equipment, to which owners of such equipment wish to limit access and document all such access. The Mas-Hamilton locks of this type limit access by providing an electronic lock or latch mechanism and document access that is granted. It will be appreciated that installation requires a fair amount of skilled labor and care. In addition to the difficulty associated with securing the locks, a further concern is the security provided by the locks when they are attached to an enclosure door. It may be possible to strike such a lock from the outside of the enclosure, that the outer portion and the inner portion of the lock assembly are disengaged from the enclosure door, allowing the enclosure to fall open.

It will be appreciated from the foregoing, therefore, that prior art devices and methods of installing these devices present problems which are in need of solutions. It also will be appreciated that further enhancements of the security provided by such locks are needed. The present invention provides solutions for these and other problems.

SUMMARY OF THE INVENTION

An enclosure suitable for use to house computer equipment, such as, a data storage network, a telecommunications network or a data communications network is provided. The enclosure has at least four sides including a front side, a rear side, a first side and a second side opposite the first side and further includes a frame, the frame including upright supports suitable for mounting equipment for use in the data storage network, telecommunications network or data communications network. The enclosure further includes an interior space defined in part by the four sides; wherein at least one of the four sides includes an enclosure door and an side opening through which the interior space is accessible when the enclosure door is in a first unsecured or open position. The opening is capable of receiving a lock assembly, the opening is defined by opening edges; the enclosure further comprising a first lock assembly secured to the door so that the door can be releasably secured in a second secured closed position when the door is closed and access to the interior space through the enclosure door opening is prevented. The first lock assembly including a securing mechanism selected from the group consisting of a lock cylinder, an electronic lock, a quarter turn latch, a compression latch, a folding T latch, a lift and turn compression latch, a pawl/cam action latch, a multi-point latch system and a bolt for securing to a rotary latch secured to the enclosure; and a mounting plate having an interior surface and an exterior surface. The securing mechanism is secured to the interior surface; wherein the first lock assembly is secured within the opening of the enclosure door by at least one bracket secured to the interior surface of the mounting plate and effectively gripping at least one of the plurality of opening edges, so that the first lock assembly is effectively secured to the first enclosure door; wherein the first lock assembly is easily exchanged with a second lock assembly by disengaging the first lock assembly from the opening and inserting the second lock assembly into the opening and securing the second lock assembly within the opening of the enclosure door with at least one bracket secured to the interior surface of the mounting plate and effectively gripping at least one of the plurality of opening edges, so that the second lock assembly is effectively secured to the first enclosure door. The second lock assembly includes a securing mechanism selected from the group consisting of a lock cylinder, an electronic lock, a quarter turn latch, a compression latch, a folding T latch, a lift and turn compression latch, a pawl/cam action latch, a multi-point latch system and a bolt for securing to a rotary latch secured to the enclosure; and a mounting plate having an interior surface and an exterior surface; the securing mechanism being secured to the interior surface. In certain embodiments, the enclosure is a co-location enclosure or unit, having a plurality of enclosure doors to a plurality of communicating interior spaces. In alternate embodiments, the present invention includes a plurality of such enclosures, one or more of which may be a co-location unit.

In a preferred embodiment, the enclosure suitable for housing network equipment includes first and second enclosure doors, each of the enclosure doors having an opening capable of receiving a lock assembly, each enclosure door having a plurality of opening edges proximate the opening; the enclosure further including first and second lock assemblies secured to the first and second enclosure doors, respectively. The first and second lock assemblies each including a securing mechanism selected from the group consisting of a lock cylinder, an electronic lock, a quarter turn latch, a compression latch, a folding T latch, a lift and turn compression latch, a pawl/cam action latch, a multi-point latch system and a bolt for securing to a rotary latch secured to the enclosure; and a mounting plate having an interior surface and an exterior surface; each securing mechanism being secured to the respective interior surface; wherein the first and second lock assemblies are secured within the respective opening of the respective enclosure door by at least one bracket secured to the interior surface of the respective mounting plate and effectively gripping at least one of the opening edges, so that each lock assembly is effectively secured to each respective enclosure door.

The present invention also provides a method of securing a lock assembly to an enclosure door of a computer equipment enclosure. The method includes providing an enclosure having at least four sides including a front side, a rear side, a first side and a second side opposite the first side and further includes a frame, the frame including upright supports or devices suitable for mounting equipment for use in the data storage network, telecommunications network or data communications network. The enclosure further includes an interior space defined in part by the four sides; wherein at least one of the four sides includes an enclosure door and a side opening through which the interior space is accessible when the enclosure door is in a first unsecured or open position. The enclosure door has an opening capable of receiving a lock assembly, the opening is defined by a plurality of opening edges; the enclosure further comprising a first lock assembly secured to the enclosure door so that the enclosure door can be releasably secured in a second secured or closed position when the enclosure door is closed so that unauthorized access to the interior space through the side opening is prevented. The method further including providing an opening in the enclosure door, the opening having a plurality of edges proximate the opening; inserting a first lock assembly into and at least partially through the opening; the first lock assembly including a securing mechanism selected from the group consisting of a lock cylinder, an electronic lock, a quarter turn latch, a compression latch, a folding T latch, a lift and turn compression latch, a pawl/cam action latch, a multi-point latch system and a bolt for securing to a rotary latch secured to the enclosure; and a mounting plate having an interior surface and an exterior surface; the securing mechanism being secured to the interior surface; wherein the first lock assembly is secured within the opening of the enclosure door by at least one bracket secured to the interior surface of the mounting plate and effectively gripping at least one of the opening edges, so that the first lock assembly is effectively secured to the first enclosure door; disengaging the first lock assembly from the opening; inserting a second lock assembly into the opening; wherein the second lock assembly includes: a securing mechanism selected from the group consisting of a lock cylinder, an electronic lock, a quarter turn latch, a compression latch, a folding T latch, a lift and turn compression latch, a pawl/cam action latch, a multi-point latch system and a bolt for securing to a rotary latch secured to the enclosure; and a mounting plate having an interior surface and an exterior surface; the securing mechanism being secured to the interior surface; and securing the second lock assembly within the opening of the enclosure door with at least one bracket secured to the interior surface of the mounting plate and effectively gripping at least one of the plurality opening edges, so that the second lock assembly is effectively secured to the first enclosure door.

The present invention is alternately directed to an enclosure including an enclosure door having a lock assembly including a dial assembly or lock actuating mechanism and a lock bolt, securing mechanism or lock case assembly, which sandwich an engagement plate or a mounting plate to which each is secured to form the lock assembly. The mounting plate preferably includes a number of different functional parts which allow the respective assemblies to be secured to the mounting plate and also allow the mounting plate to permit the lock assembly to be secured within an opening within an enclosure door. The lock assembly is just one of a number of lock assemblies that can be substituted for one another with relative ease, giving the present invention a practical value to owners, that can easily substitute one lock assembly for another when the security requirements for an enclosure changes, requiring differing security parameters.

In one preferred embodiment, the mounting plate includes a plurality of drilled and tapped holes, a plurality of Standoffs and a plurality of securing studs. In the further preferred embodiment, a lock assembly for attachment to an enclosure door is provided, comprising: a lock case assembly including a bolt having at least first and second positions; a lock actuating mechanism interconnected with the lock case assembly such that the lock actuating mechanism can actuate a change in the position of the bolt from the first position to the second position; and a mounting plate having an interior surface and an exterior surface; the lock actuating mechanism being secured to the mounting plate on the exterior surface and the lock case assembly being secured to the mounting plate on the interior surface. The lock case assembly is preferably secured within an opening by at least one bracket secured to the interior surface of the mounting plate and effectively gripping an edge of an opening in the enclosure door.

In further preferred embodiments, the present invention provides an enclosure door having a lock assembly, including a mounting plate such as the mounting plate disclosed hereinabove, secured within an opening in the enclosure door.

In a further preferred embodiment, the present invention provides a method for securing a lock assembly to an enclosure door, the method including providing an opening in the enclosure door, inserting the lock assembly in the opening and securing the lock assembly to the enclosure door.

The lock assembly preferably includes a lock case assembly having a bolt that can be moved between at least two positions; a lock actuating mechanism interconnected with the lock case assembly such that the lock actuating mechanism can actuate a change in the position of the bolt from one position to the other; and a mounting plate having an interior surface and an exterior surface. The lock actuating mechanism is secured to the mounting plate on the exterior surface and the lock case assembly is secured to the mounting plate on the interior surface. The lock assembly itself is secured within the opening of the enclosure door by a bracket, preferably two such brackets, which are secured to the interior surface of the mounting plate and effectively grip an edge or preferably edges of the enclosure door proximate the opening so that the lock assembly is secured to the enclosure door.

It is an object of the present invention to provide an enclosure for computer equipment that allows secure access. In preferred embodiments, access will be monitored by electronic locks that record information regarding access to the interior space within the enclosure.

It is a further object to provide a series of lock assemblies including a standardized mounting plate for securing to a standardized opening in enclosure doors of the preferred enclosures. This allows a range of lock assemblies to be secured to each of the respective enclosure doors. In this way, the manufacturer may deliver the enclosure or enclosures to a purchaser with any type of lock assembly or with none at all. The purchaser may then determine which type of lock assembly is desirable to meet the purchaser's needs at any particular time. In this way, the enclosures have significant versatility and the type of lock assembly may be easily changed without the assistance of workers having mechanical skills other than relatively low-level assembly skills. It is envisioned that this versatility will provide significant cost savings to purchasers and greater satisfaction with the enclosures purchased in view of this projection cost savings. It will be appreciated that in certain situations simple lock assemblies may be suitable for a particular enclosure. In other situations, an electronic lock will be required. It will be appreciated that it is an object of the present invention to provide enclosures having easily interchangeable securing mechanisms.

It is a further object of the present invention to provide an enclosure having two enclosure doors, the first of which includes an electronic lock and the second of which is secured in a closed position by a simple latch that can be released from the interior space of the enclosure, once the enclosure door secured by the electronic lock is opened, thereby reducing the need for a more substantial or, perhaps, more expensive, securing assembly on the second enclosure door.

It will be appreciated that the enclosures of the present invention may have a variety of lock or securing assemblies, each having a mounting plate which has standard features to allow the respective securing lock assemblies to be secured to a standardized securing assembly opening in the enclosure door or doors. In certain embodiments, a number of gangable enclosures will be ganged together as a series of computer equipment enclosure devices. In other embodiments, the enclosure may be a co-location enclosure device having a series of communicating or non-communicating interior spaces secured by separate enclosure doors. It will be appreciated that these co-location enclosure units may also be gangable and secured together in a series of enclosure units.

It will be appreciated that the present lock assembly reduces the complexity of installation of locks of this type and reduces the expense associated with such installation and also reduces the amount of time and energy associated with such installation.

It is a further object of the present invention, to provide a lock assembly, which can be installed in a standard enclosure door in a straightforward and expeditious manner without disassembly of the securing assembly prior to installation. In the most preferred embodiment, the lock assembly is installed by placing the lock assembly within an opening provided in the enclosure door and securing the lock assembly to the enclosure door by placing at least one, preferably two, brackets over respective pairs of securing studs, securing the brackets to the respective securing studs with stud securing nuts which are tightened such that the brackets grip edges of the opening of the enclosure door.

It is a further object of the present invention to provide a simplified electronic securing assembly which is easy to install, easy to remove for repair or enhancement and easy to reinstall or replace.

It is a further object of the present invention to provide a system for enhanced security for enclosure doors by providing a mounting plate which secures the lock case assembly to the enclosure door even if the lock actuating mechanism is destroyed or disengaged from the mounting plate.

It is a further object of the present invention to provide a mounting plate which is specifically designed to secure the lock case or securing mechanism to the interior surface of the mounting plate while the enclosure door is secured to the interior side of the mounting plate as well, thereby enhancing the security provided by the mounting plate, as well as the present lock assembly.

It is a further object of the present invention to provide a kit including the mounting plate and other accessories, preferably brackets and a plurality of stud securing nuts for securing the mounting plate to an enclosure door having an opening suitable for mounting the present mounting plate.

The above-described features and advantages along with various other advantages and features of novelty are pointed out with particularity in the claims annexed hereto and forming a part hereof. However, for a better understanding of the invention, its advantages and objects attained by its use, reference should be made to the drawings which form a further part hereof and to the accompanying descriptive matter, preferred embodiments of the present invention.

BRIEF DESCRIPTION OF THE DRAWINGS

Referring now to the drawings, in which like reference numerals refer to equivalent elements in a series of embodiments of the present invention:

FIG. 3 is an exploded perspective view of the lock assembly 2 shown in FIGS. 1 and 2 as it would come apart when secured within an opening 26 within an enclosure door 28;

FIG. 13 is a view similar to that shown in FIG. 12, except that the rear enclosure door 106 is open and slightly ajar and the bolt assembly 116 is not in contact with the rotary latch 115;

DETAILED DESCRIPTION OF THE PREFERRED EMBODIMENTS

Figure 1:
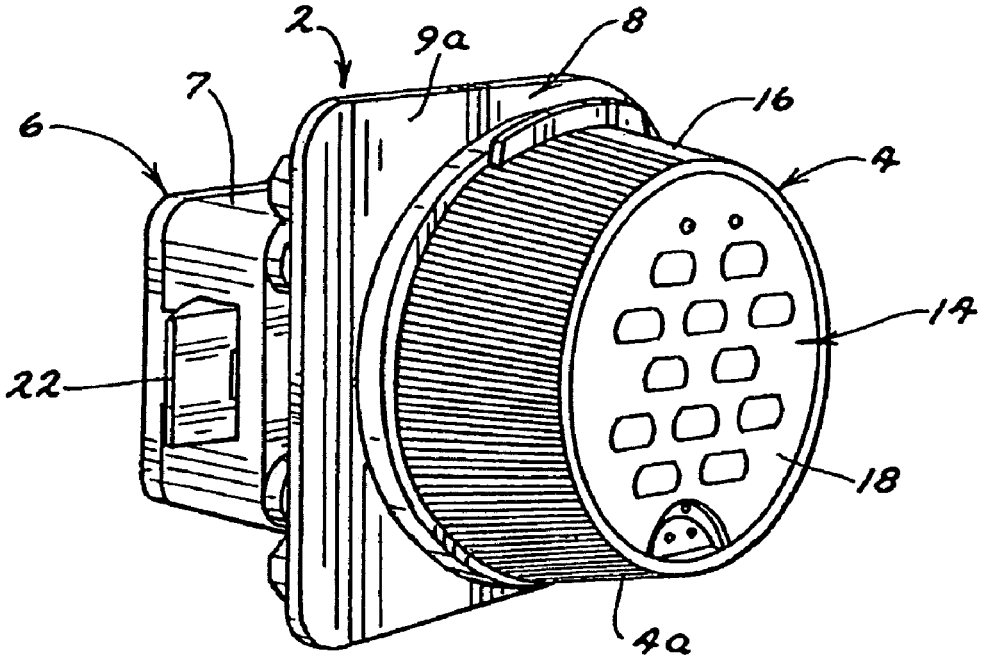
FIG. 1 is a perspective view of a preferred lock assembly 2 of the present invention showing an exterior surface 9*a* of a mounting plate 8 sandwiched between a lock actuating mechanism 4 and a lock case assembly 6.
Figure 2:
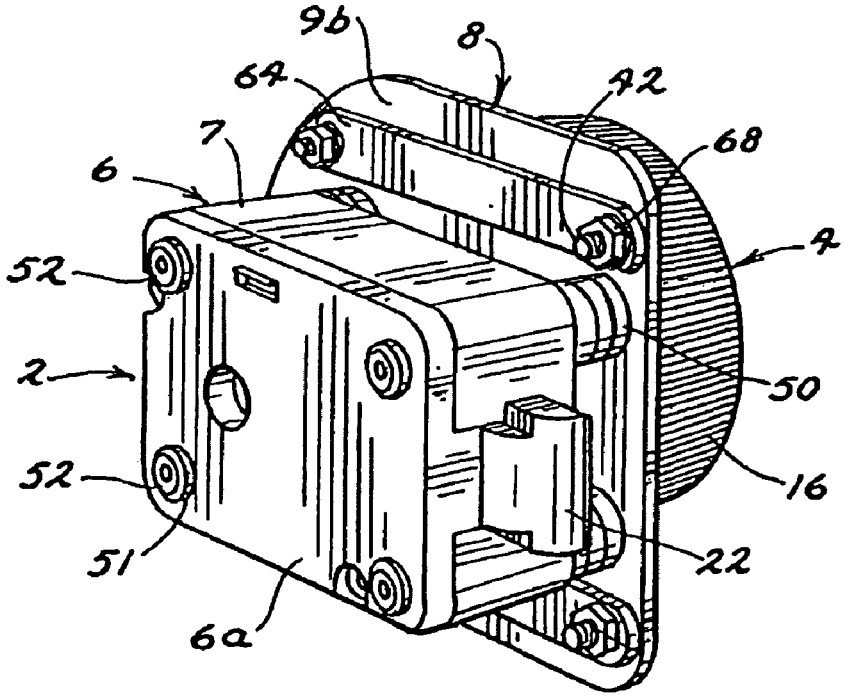
FIG. 2 is a further perspective view of the lock assembly 2 shown in FIG. 1, but showing an interior surface 9*b* of the mounting plate 8.

Referring now to FIGS. 1 and 2, the present invention preferably includes a lock assembly 2 including a dial assembly or lock actuating mechanism 4, a lock case or bolt assembly 6 and a mounting plate 8. The mounting plate has an exterior surface 9*a*, shown primarily in FIG. 1, and an interior surface 9*b*, shown primarily in FIG. 2.

Figure 4:
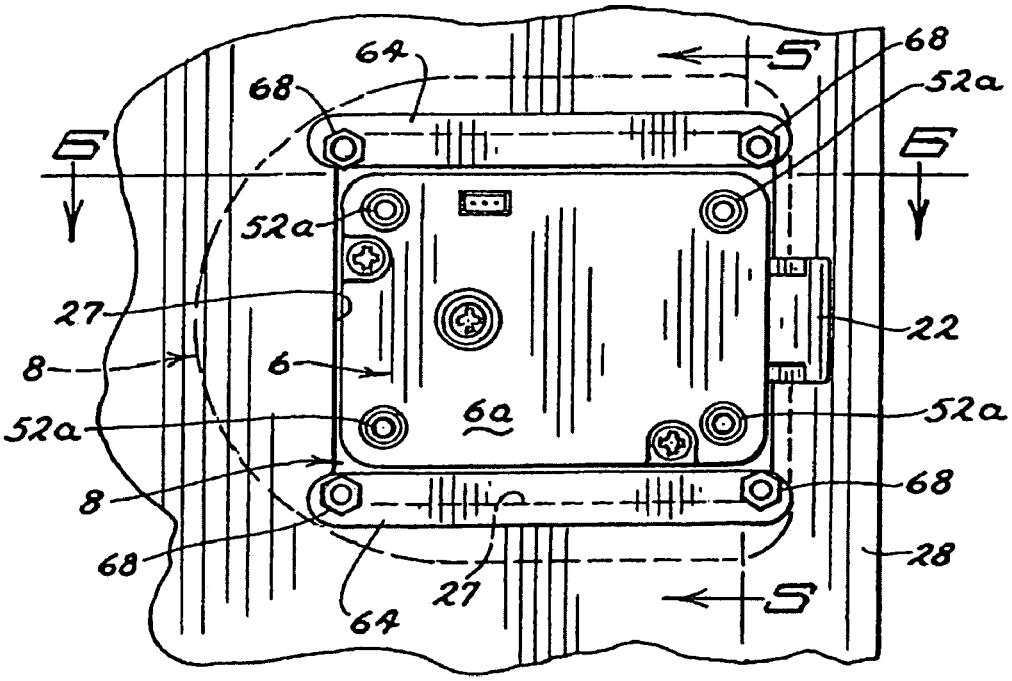
FIG. 4 is a side plan view of the lock assembly shown in FIGS. 1 and 2 from the inside 29 of the enclosure door 28 showing the outline of the mounting plate 8 and the outline of the opening 26 at least partially in phantom.
Figure 5:
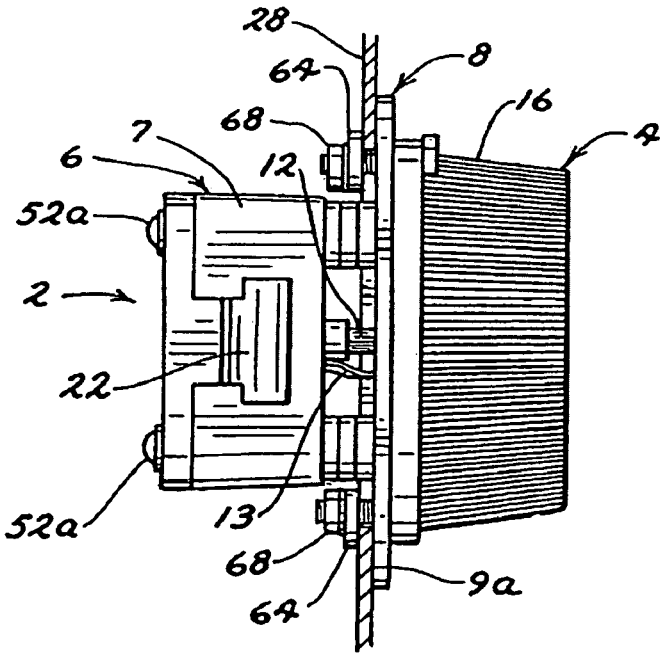
FIG. 5 is a side elevation of the lock assembly 2 when engaged with the enclosure door 28 as seen from line 5-5 of FIG. 4, showing the enclosure door 28 in a cross-section.

Referring now also to FIG. 3 which provides an exploded view of parts of the preferred lock assembly 2 when secured to an enclosure door 28, as shown in FIGS. 4 and 5, to which reference is also made at this time.

The preferred lock assembly 2 shown in FIGS. 1-5 includes a mounting plate 8 having a center hole 10 through which a spindle 12, extending from the lock case assembly 6 can extend to become engaged within the lock actuating mechanism. The preferred lock actuating mechanism 4 and lock case assembly 6 are respective parts of an AUDITCON™ lock available from Kaba Mas, Inc., Lexington, Ky., such as the series 50R, 52R, 100R, 200R, 400R, 500R and 2100R series AUDITCON™ locks.

Other locks may be substituted for the preferred lock. These locks include the V series, LP series, Vindication™ series, X08/X07 series, LC series and the like locks from Kaba Mas or Mas-Hamilton, the ComboGuard®, DelaGuard®, TimeDealy™, SafeGuard™, TwoBolt™, Privat®, SmartGuard™, DigiGuard®, LGAudit™, LGBasic™, LGCombo™, eCam®, MultiGuard™, VisionGuard™ and the like series from LeGard, and the Comptronic® 6120, 6121, 6123, 6124, 6125, 6140, 6150 and the like series from Sargent & Greenleaf, along with any other similar two, or more, component lock systems from these or other access lock or other lock manufacturers.

The preferred lock actuating mechanism 4 includes a keypad 14, which allows the user to enter an access code which, once entered, will cause the lock actuating mechanism to actuate movement of a bolt 22 in the lock case assembly 6 by turning the spindle 12. Mas-Hamilton also produces similar locks having a low profile housing (now shown) and a vertical lock housing (not shown). The Mas-Hamilton locks have two different modes of operation, an independent mode and a Supervisory/Subordinate mode. Within each operation mode, two access modes are available: Single User access and Dual User access. In Single User access, only one combination is required to open the lock. In Dual User access, two combinations must be correctly and consecutively entered to open the lock.

Independent mode—When operating in Independent mode, only one (Single User access) or two (Dual User access) combinations are required to open the lock. In Dual User access, either combination can be entered first. However, you should not turn the dial or press Clear between combination entries.

Supervisory/Subordinate mode (Super/Sub mode)—When operating in Super/Sub mode, a Supervisor must first enable lock access for Subordinate User(s) in order for them to be able to open the lock. In Single User access, two separate combinations are required to open the lock. A Supervisor combination followed by an assigned Supervisor ID must be entered first to enable lock access for a Subordinate User combination. The Subordinate User combination can be entered an unlimited number of times thereafter to open the lock. Once the Supervisor combination and the assigned Supervisor ID are re-entered to disable lock access for a Subordinate User, the Subordinate User combination will no longer open the lock.

In Dual User access, three separate combinations are required to open the lock. A Supervisor combination followed by an assigned Supervisor ID must be entered first to enable lock access for two Subordinate User combinations. The Subordinate User combinations can be entered an unlimited number of times thereafter (and in any order) to open the lock. Once the Supervisor combination and the assigned Supervisor ID are re-entered to disable lock access for the Subordinate User(s), these Subordinate User combinations will no longer open the lock.

There are four different types of classifications of personnel who can access the lock:

Master User—The Master User performs the initial lock setup activities. There is a maximum of one Master User per lock. The Master User combination will not open the lock.

Access User—In Independent mode, a user added by a Master User.

Supervisor—In Supervisory/Subordinate mode, a user added by the Master User and who has the ability to add/delete other Subordinate users. The maximum number of Supervisors per lock varies according to lock model. A Supervisor cannot open the lock.

Subordinate User—In Supervisor/Subordinate mode, a user who is added by and assigned to a Supervisor.

Figure 6:
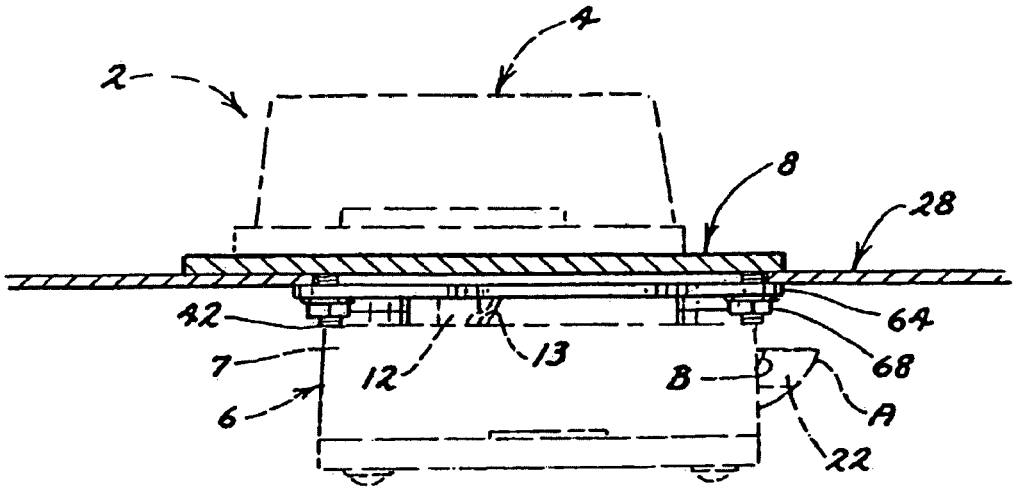
FIG. 6 is a partial cross-sectional view from the top of the lock assembly 2 shown in FIG. 4 as seen from the line 6-6 showing the enclosure door 28 and the mounting plate 8 in cross-section and wherein the lock actuating mechanism 4 and the lock case or bolt case assembly 6 are shown in phantom.

Referring now also to FIGS. 4, 5 and 6, the preferred lock assembly 2 includes a lock actuating mechanism for, a lock case or bolt assembly 6 and a mounting plate 8 as shown in FIGS. 1 and 2, when fully assembled. When secured to an enclosure door 28, as shown in FIGS. 4-6, the interior side or surface 9*b* of the mounting plate 8 is secured against an outer surface of the enclosure door 28. In FIG. 6, the tip of the bolt 22 is shown in phantom once in a first position, A, where the tip is extended out away from the lock case assembly housing 7 and a second position, B, in which the tip of the bolt 22 protrudes only slightly from the lock case assembly housing 7. It is envisioned that the bolt 22 will engage a structure (not shown) associated with the enclosure (not shown) when the enclosure door 28, preferably pivotally attached, is attached to the enclosure (not shown). In this way, the bolt 22 will provide a mechanism for engaging the enclosure structure (not shown) when it is in the first position in which the lock assembly 2 will engage the enclosure (not shown) to keep the enclosure door 28 in a secured and closed position (not shown).

Figure 7:
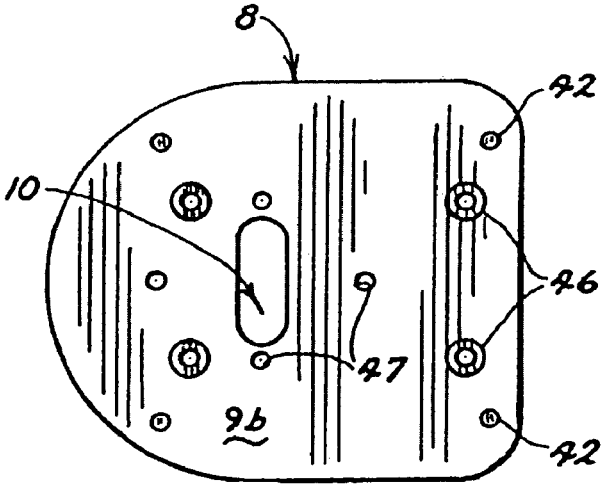
FIG. 7 is a to plan view of the mounting plate 8 showing the interior surface 9*b;*
Figure 8:
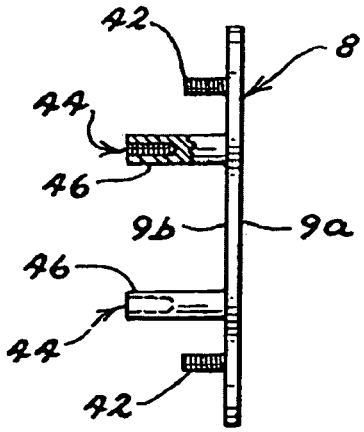
FIG. 8 is a right side elevation of the mounting plate 8, shown in FIG. 7, showing one of the two standoffs 46 in partial cross-section and the tapped hole in the other standoff 46 in phantom.
Figure 9:
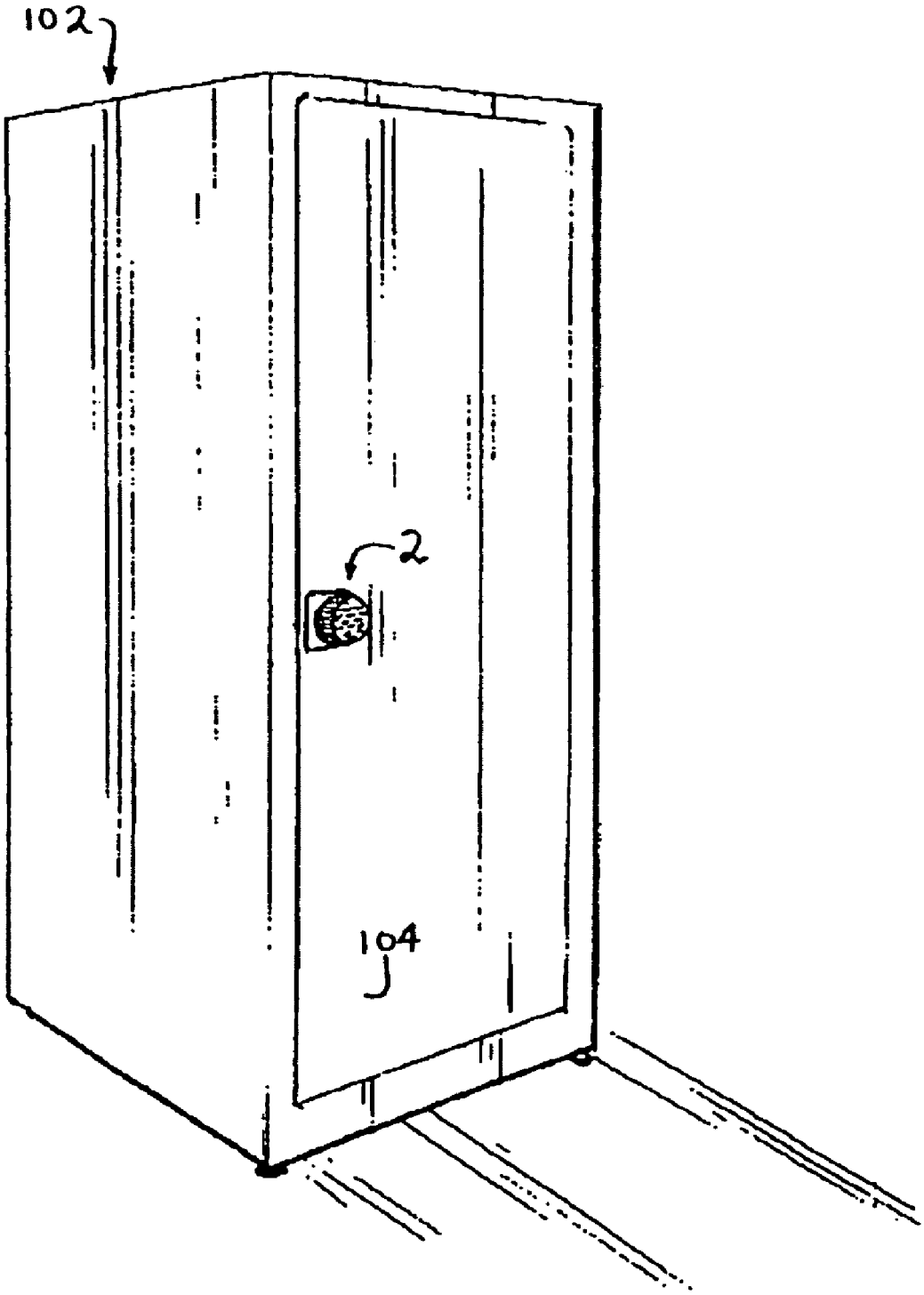

Referring now also to FIGS. 7 and 8, the mounting plate 8 of the present invention preferably has a shape similar to that shown in FIG. 7. In alternate embodiments, the shape of the mounting plate may vary, and the position of the various openings, holes or attachments to the mounting plate may be varied as well in order to accommodate a variety of lock actuating assemblies, lock case assemblies and the like. The main feature of the mounting plate 8, however, is that it will provide a plate having an exterior surface 9*a* and an interior surface 9*b*. The preferred mounting plate 8 includes four securing studs 42 attached to the interior surface 9*b*. In the present application, the term "securing stud" means a protrusion extending away from the interior surface 9*b* of the mounting plate 8, to which a securing bracket 64 may be secured. These securing studs 42 can be threaded studs, welded or weld studs, PEM® studs or the like. A securing bracket 64, such as the interior mounting plate securing bracket 64, see FIGS. 4-6, can be secured to the securing studs, but other well known fastening systems can also be used. In preferred embodiments, the securing studs are threaded such that they accept stud securing nuts which screw onto the securing studs 42 to secure a securing bracket 64 which can grip an edge 27 of the opening 26 in the enclosure door 28. In a preferred embodiment, the securing studs 42 are PEM® studs from Pem Fastening Systems, Danboro, Pa. that are pressed into drilled or drilled and tapped holes, stamped holes, or the like. Alternatively, the securing studs 42 are spot welded onto the interior surface 9*b* of the mounting plate 8.

The mounting plate 8 also includes four T-nuts 46 or standoffs 46 having standoff receiving openings 44 in which standoff screws 52, for securing the lock case assembly 6, can be secured. In preferred embodiments, the lock assembly 2 includes a plurality of Standoff spacers 50 that are used to separate the lock case assembly 6 from the mounting plate 8 a sufficient distance to permit the standoff screw to bind the lock assembly standoff screws 52 to tightly secure the lock case assembly 6 to the mounting plate 8. A washer 51 is also used to space the head 52*a* of the screw 52 away from an upper surface 6*a* of the lock assembly so that the standoff screw 52 effectively secures the lock assembly 6 to the mounting plate by engaging the threaded standoff receiving openings 44 in the standoffs 46.

The mounting plate also includes the center hole 10, which allows the spindle 12 to pass through the mounting plate 8 from the lock case assembly 6 to the lock actuating mechanism 4. A wire harness 13 also passes through the mounting plate to connect the lock actuating mechanism 4 electronically with the lock case assembly 6 so that the act of entering a recognized code into the keypad 14 of the lock actuating mechanism is effective to permit the spindle 12 to turn within the lock case assembly 6 and move the bolt 22 from the first position 22*a* to the second position 22*b* (shown in FIG. 6 in phantom). The preferred mounting plate 8 also includes four drilled and tapped holes 47 which accept lock actuating mechanism securing screws 48 which secure the lock actuating mechanism 4 to the exterior surface 9*a* of the mounting plate 8.

The preferred electronic assembly 2 is assembled by displacing the keypad 14 from the lock actuating mechanism 4 in order to secure the remaining housing for A to the exterior surface 9*a* of the mounting plate 8. Lock actuating mechanism securing screws 52 or standoff screws 52 are used to secure the lock actuating mechanism housing 4*a* to drilled and tapped holes 47 in the mounting plate. The keypad 14 is then secured to the lock actuating mechanism housing 4*a*. The lock case or bolt assembly 6 is also secured to the mounting plate 8 using screws 52. Four standoff screws 52 are used to secure the lock case assembly to the interior surface of the mounting plate.

The lock assembly 2 also includes two brackets 64 which can be secured to the interior surface 9*b* of the mounting plate 8 by a plurality of stud securing nuts 68 which can secure the brackets 64 to the weld stud 42 in the manner shown in FIG. 2.

To secure the lock assembly 2 to the enclosure door 28, however, the brackets 64 are preferably disengaged from the securing studs 42 and engaged with the enclosure door 28 within the opening 26. To secure the lock assembly 2, within the opening 26, the brackets 64 are placed over the securing studs 42 when the lock assembly 2 is in place in the enclosure door 28 within the opening 26, thereby sandwiching edges 27 of the opening 26 between the mounting plate 8 and respective brackets 64. Stud securing nuts 68 are used to secure the brackets against the edges 27 of the opening so as to grip the enclosure door 28 between the brackets 64, respectively, and the mounting plate 8.

In a preferred embodiment, the present invention provides a kit including a mounting plate 8 of the present invention and two brackets 64. In preferred embodiments, the kit also includes stud securing nuts 68, spacers 50 and standoff screws 52.

In a further, preferred embodiment of the present invention, a method of securing the lock assembly 2 to an enclosure door 28 is provided, including the steps of creating an opening 26 in the enclosure door 28; placing the lock assembly 2 within the opening 26 in the enclosure door 28; and securing the lock assembly 2 within the opening by securing at least one bracket to the interior surface 9*b* of the mounting plate 8 and sandwiching at least a portion of the enclosure door 28 between the bracket and the mounting plate 8 in such a manner that the lock assembly 2 is functionally secured to the enclosure door 28.

The present lock assembly 2 has been designed to simplify the installation of a lock, preferably an AUDITCON™ lock available from Kaba Mas, Inc. Installation using the lock assembly 2, requires providing a hole 26 in a door 28 to an enclosure (not shown), preferably a rectangular or square hole in certain embodiments, although the hole may vary in its configuration and size.

It is an object of the present invention to provide an assembly 2 which preferably includes components of a lock such as the AUDITCON™ lock for incorporation into an enclosure door 28 to limit access to an interior (not shown) of an enclosure (not shown). It is a further object of the present invention to provide a quickly attached assembly 2 for such use.

In order to install the preferred lock assembly 2 of the present invention in a computer enclosure (not shown), the enclosure door opening 26 is preferably provided in the enclosure door 28. In preferred embodiments, the enclosure door opening 26 is a rectangular or, perhaps, square opening.

The lock assembly 2 is secured to the enclosure door 28, within the enclosure door opening 26 by placing the lock assembly 2 within the enclosure door opening 26 and securing brackets 64 to the respective securing studs 42 using alternate stud securing nuts 68, such as Nyloc nuts or the like. The preferred stud securing nuts 68 hold the brackets 64 against the enclosure door 28 at edges 27 of the enclosure door opening 26 to secure the lock assembly 2 to the enclosure door 28. In the side view of the lock assembly 2, shown in FIGS. 4-6, the lock assembly 2 is shown secured to the enclosure door 28.

The simplicity with which the preferred lock assembly 2 can be installed within a computer enclosure door 28 is discussed. In preparation for installation, an opening 26 is provided in the enclosure door 28. The lock assembly 2 is then inserted into the opening 26 from the outside of an enclosure door 28 so that the lock case assembly 6 is inserted into the opening 26 and each of the securing studs 42 are placed within the opening 26 so that the mounting plate 8 abuts against the outside or exterior 30 of the enclosure door 28. As shown in FIG. 3, the brackets 64 are then placed on the securing studs 42, thereby sandwiching the edges 27 of the opening 26 between the brackets 64, respectively, and the mounting plate 8. Once the brackets 64 are placed on the respective securing studs 42, stud securing nuts 68 are screwed onto the securing studs 42 to secure the lock assembly 2 to the enclosure door 58 as shown in FIGS. 4-6. The stud securing nuts may be tightened using an appropriate tightening tool not shown.

Although the preferred electronic lock of the present invention is an AUDITCON™ lock in the R series, AUDITCON™ locks having a low profile housing (LP) or a vertical lock housing (V) are also encompassed by the present invention. Furthermore, a number of different electronic locks may also be substituted for the AUDITCON™ locks including any of the electronic locks mentioned above, which are presently available in the industry, and any other similar locks. If necessary, minor modifications to accommodate attachment of the lock actuating mechanism and the lock case assembly for these alternate electronic locks may be made without departing from the scope of the present invention.

In preferred embodiments, the lock assembly 2 is both mechanically and electronically interconnected with the lock case assembly. The lock actuating mechanism 4 includes a code receiving mechanism 14 for entering access codes and an actuating member 16 operatively connected with the lock case assembly 6. The code receiving mechanism is electronically connected with the lock case assembly 6 such that the lock case assembly 6 can function, in response to an electronic signal from the lock actuating mechanism 4 resulting from entering a predetermined access code into the code receiving mechanism 14, in a manner permitting the position of the bolt 22 to be changed from the first position to the second position by separately mechanically actuating the change of position of the bolt 22 from the first position to the second position by using physical force to change the position of the actuation member 16.

There are other two component locks systems that operate somewhat differently from the lock of the preferred embodiment. In an alternate embodiment (not shown), the alternate lock includes a bolt is spring biased such that the bolt is biased toward the first position, the lock actuating mechanism is electronically interconnected with the lock case assembly and the lock actuating mechanism includes a code receiving mechanism for entering access codes, wherein the code receiving mechanism is electronically connected with the lock case assembly such that the lock case assembly can function, in response to an electronic signal from the lock actuating mechanism resulting from entering a predetermined access code into the code receiving mechanism, in a manner permitting the bolt to be depressed from the first position such that it can be depressed sufficiently to be in the second position.

In a further alternate embodiment (not shown), the alternate lock includes a lock actuating mechanism which is electronically interconnected with the lock case assembly, the lock actuating mechanism includes a code receiving mechanism for entering access codes and the code receiving mechanism is electronically connected with the lock case assembly such that the lock case assembly can function, in response to an electronic signal from the lock actuating mechanism resulting from entering a predetermined access code into the code receiving mechanism, to change the position of the bolt from the first position to the second position by separately mechanically actuating the change of position of the bolt.

Figure 9:
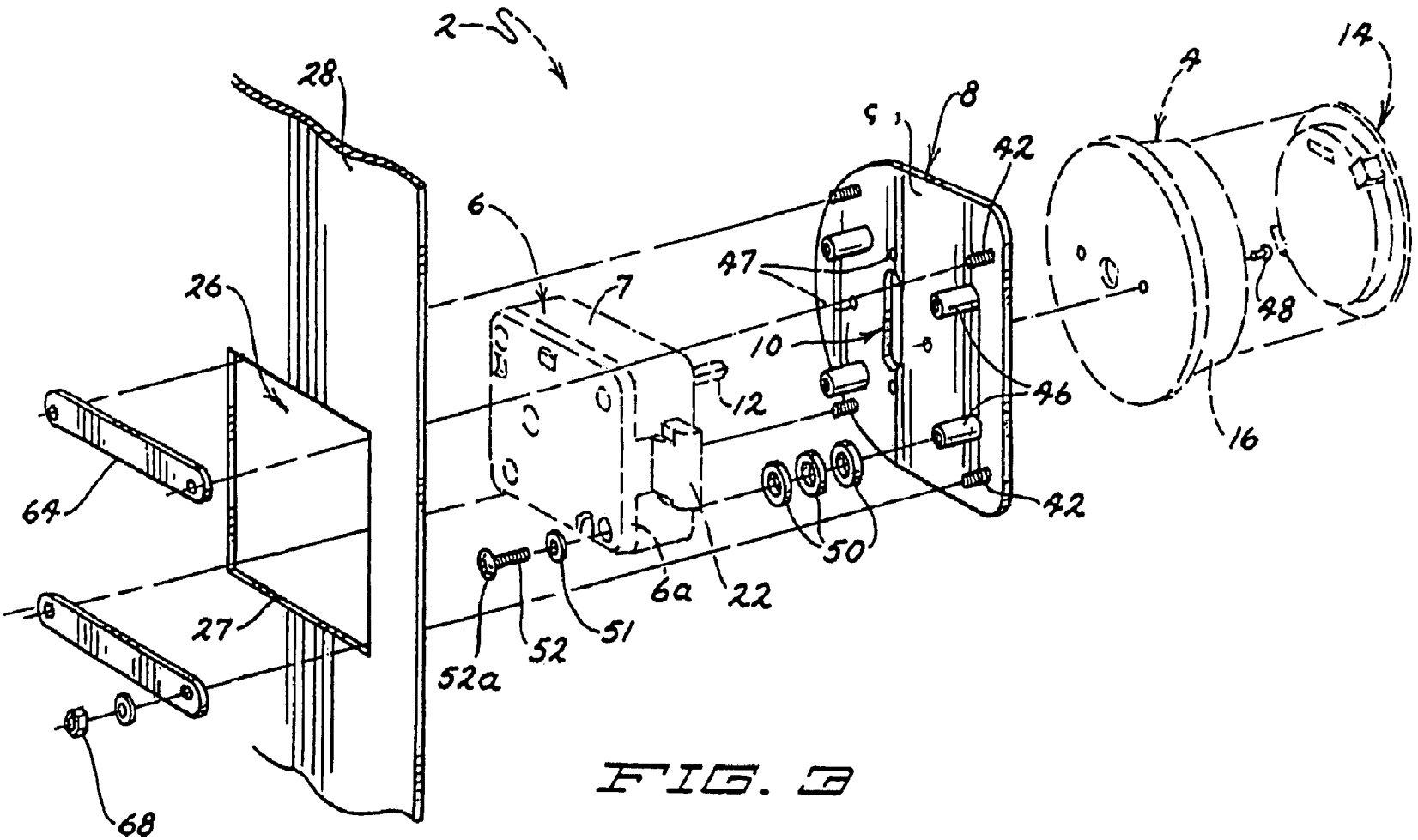
FIG. 9 is a perspective view of a vertical cabinet or enclosure 102 having an electronic lock assembly 2 of the kind shown in FIGS. 1-6, and also showing the electronic lock assembly 2 secured to the front door 104 of the enclosure 102 in the manner shown in FIGS. 3-6.
Figure 10:
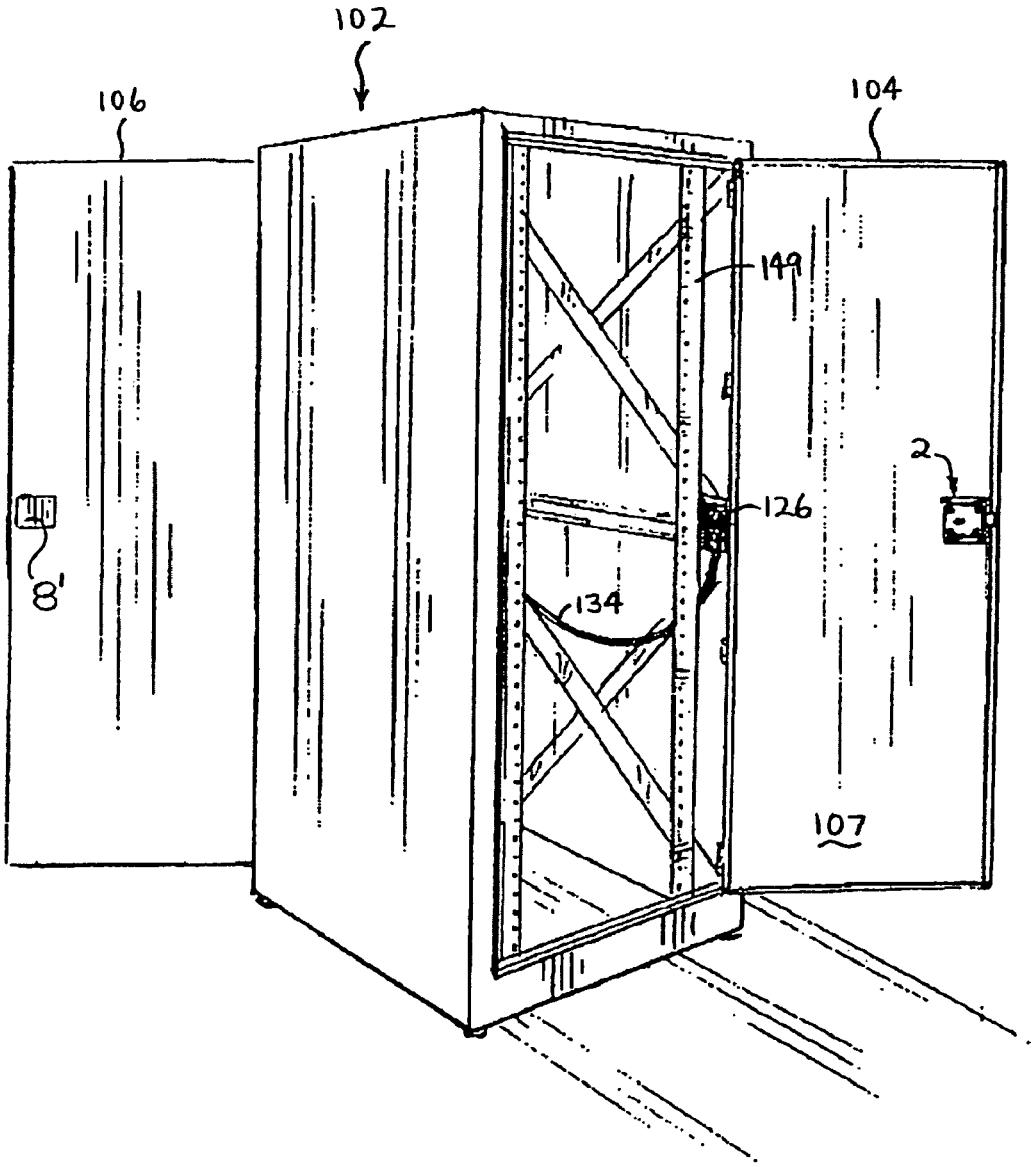
FIG. 10 is a perspective view of the enclosure 102 shown in FIG. 9, but showing both the front enclosure door 104 and the rear enclosure door 106 in unsecured open positions.
Figure 11:
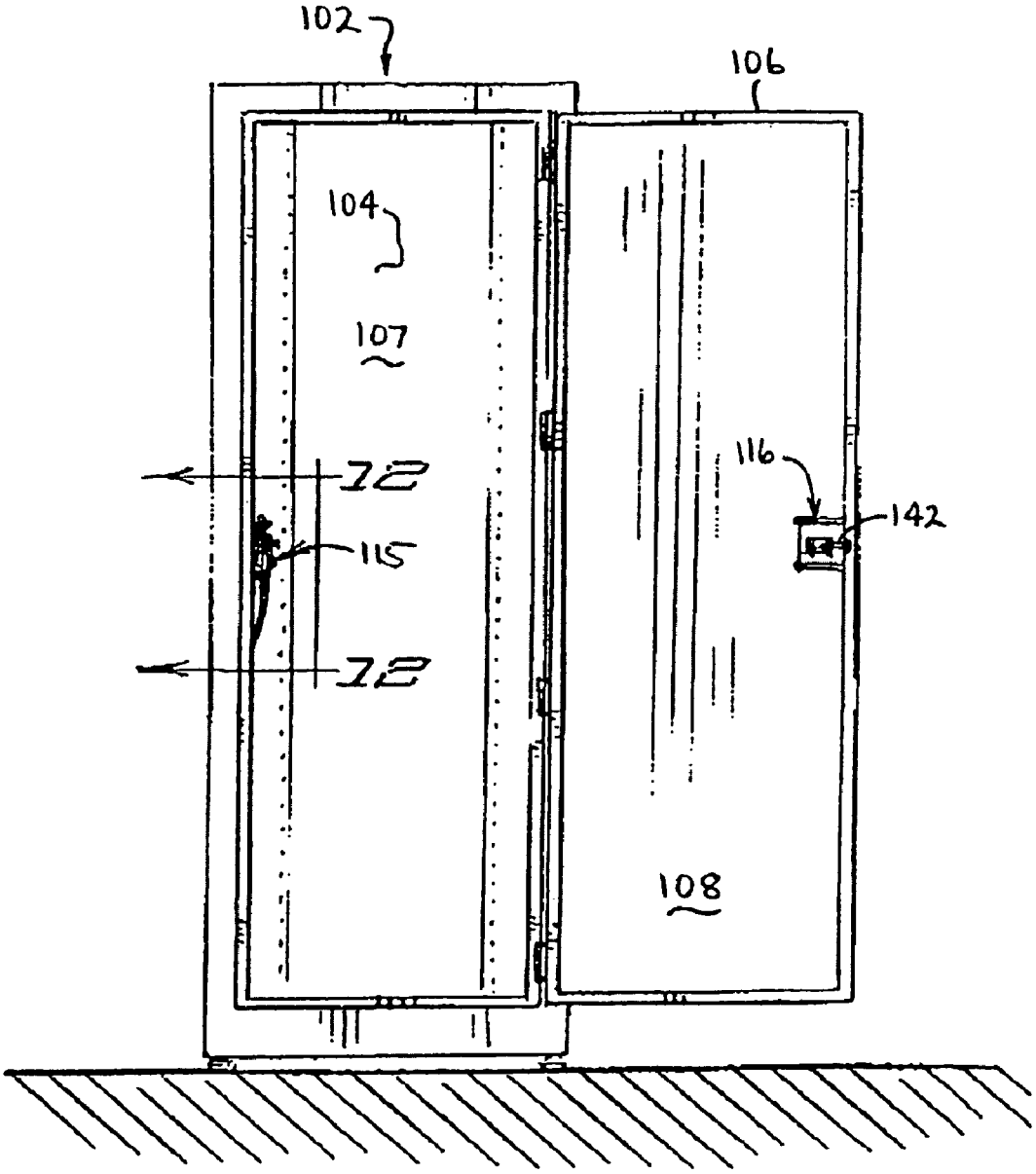
FIG. 11 is a perspective view of the enclosure 102, showing the rear enclosure door 106 in an open position.

Referring now also to FIGS. 9 and 10, the present invention also includes an enclosure 102 having a plurality of enclosure doors 104, 106. In FIG. 9, the front or first door 104 is secured in a closed position by an electronic lock assembly 2 of the type previously described. The enclosures 102 of the present invention include enclosures of the kind disclosed in U.S. Pat. Nos. 6,515,225 and 6,185,098, the disclosures of which are incorporated by reference.

Figure 12:
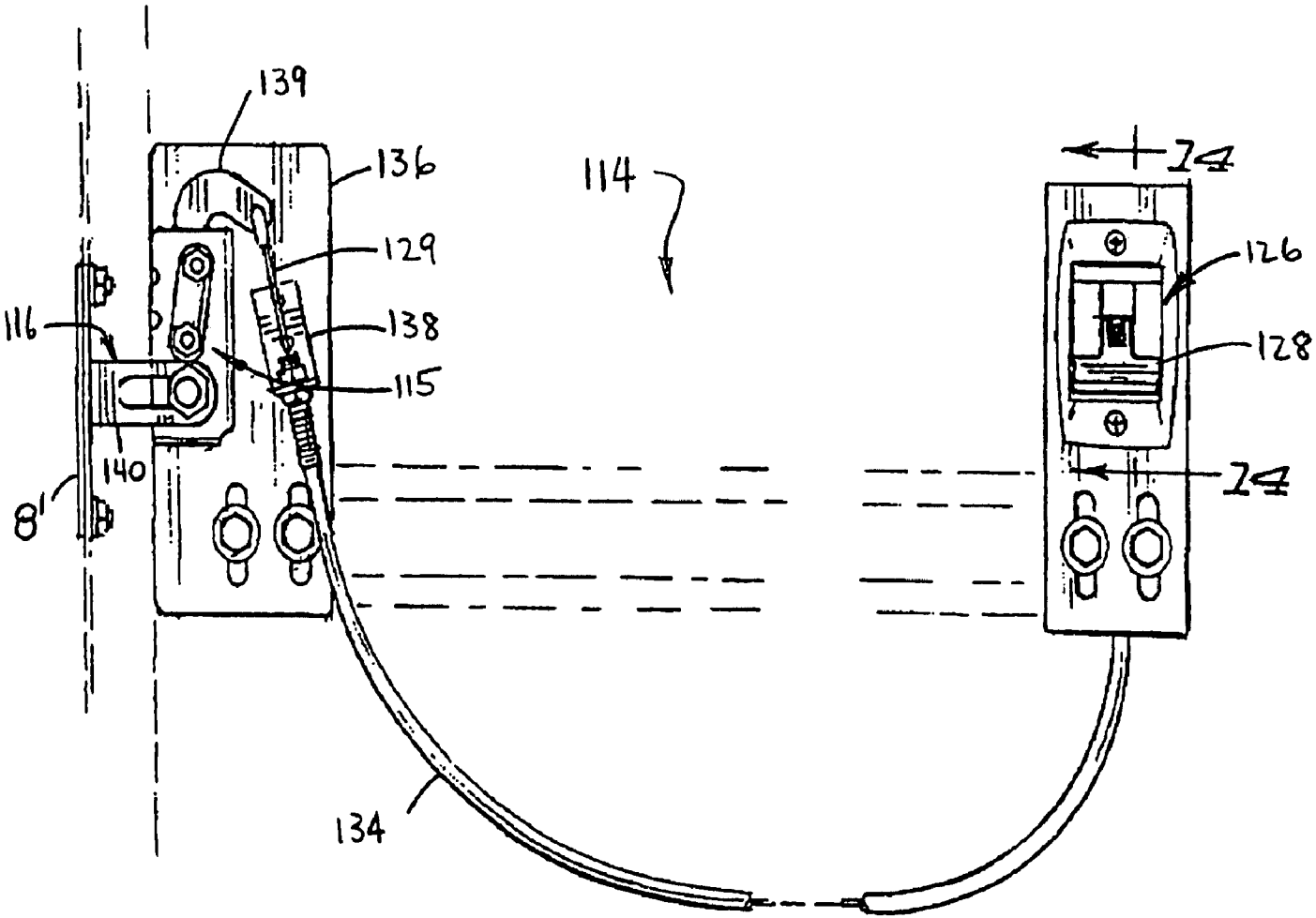
FIG. 12 is a view from the line 12-12 of FIG. 11, but when the rear enclosure door 106 is in a secured or closed position; the figure showing a rotary latch assembly 114 secured to components of the enclosure 102, shown in phantom, in such a manner that the rotary latch 115 grips a bolt assembly 116 to secure the rear enclosure door 106 (shown in phantom) in the secured or closed position as shown.
Figure 19:
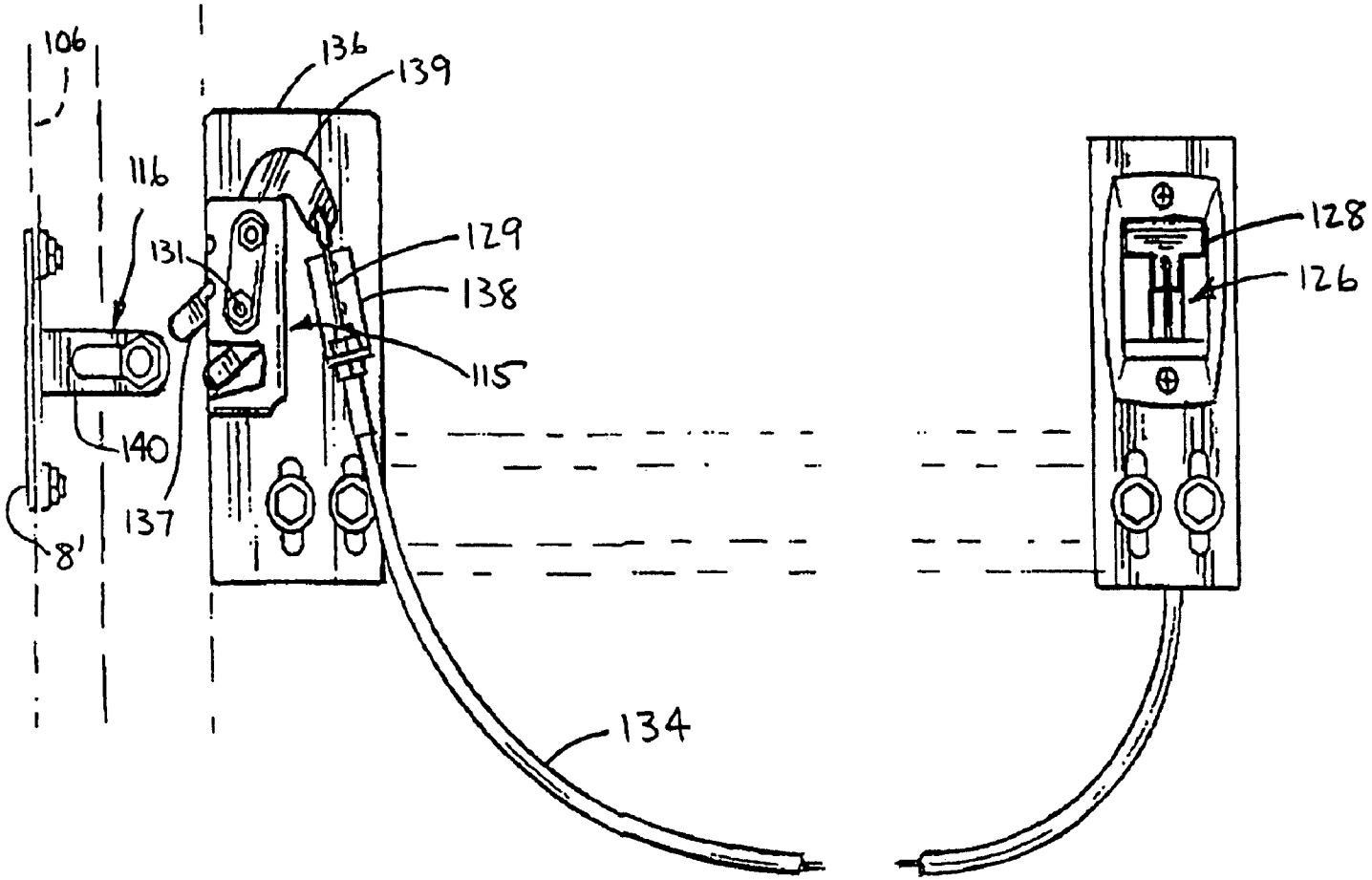
FIG. 19 is a front elevation of a second alternate locking L-handle assembly 2" similar to the first alternate lock assembly 2' except for the L-handle 159 in place of the T-handle 158.
Figure 14:
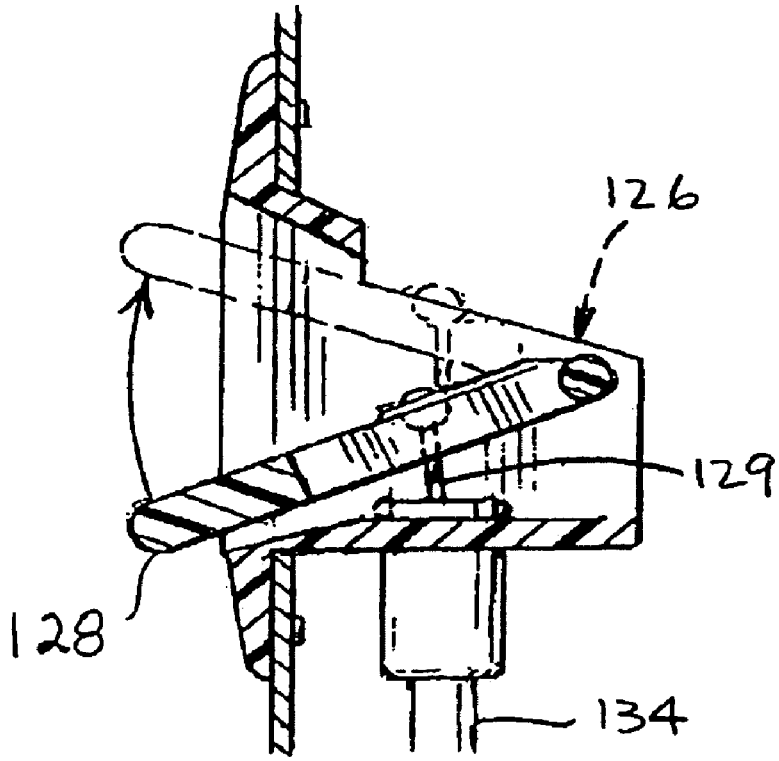
FIG. 14 is a side view of a release 126 of the rotary latch assembly 114 as seen from line 14-14 of FIG. 12.
Figure 16:
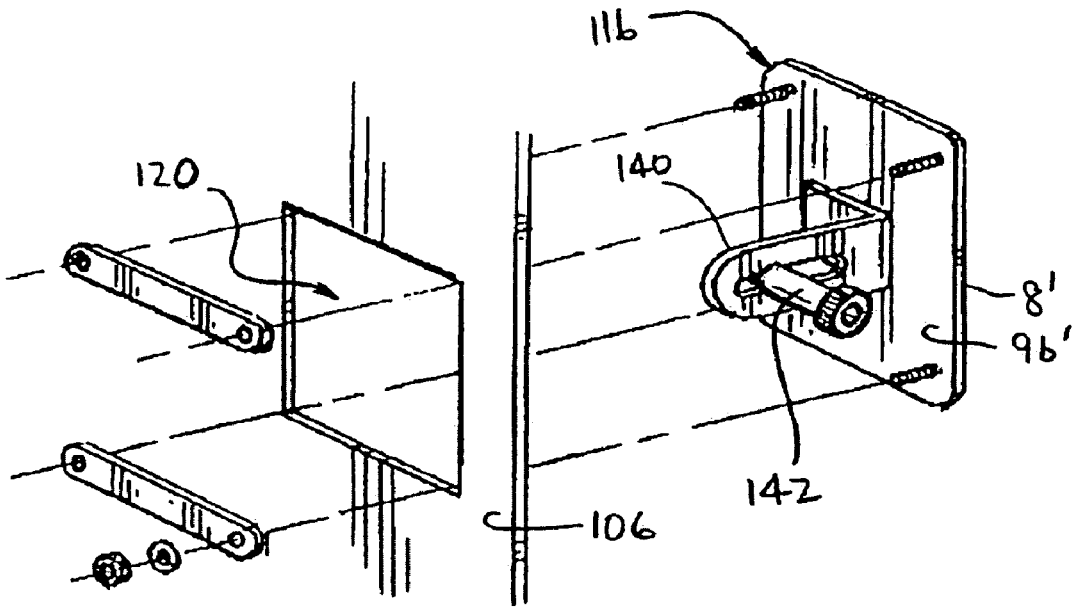
FIG. 16 is an exploded perspective view showing parts of the bolt assembly 116, shown in FIGS. 12 and 13 and showing the interior surface 9*b'* of the mounting plate 8' and the interior surface 108 of the rear enclosure door 106.
Figure 17:
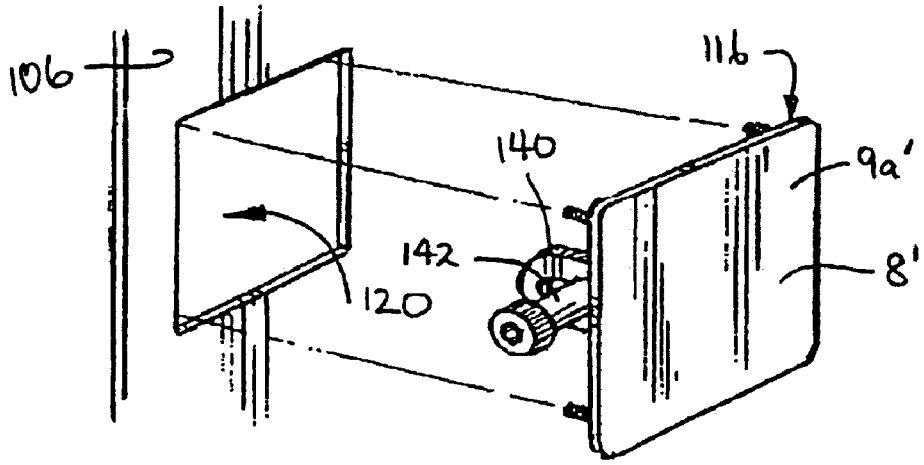
FIG. 17 is an exploded perspective view showing parts of the bolt assembly shown in FIGS. 12, 13 and 16 and showing the exterior surface 9*a'* of the mounting plate 8' and the exterior surface 109 of the rear enclosure door 106.
Figure 18:
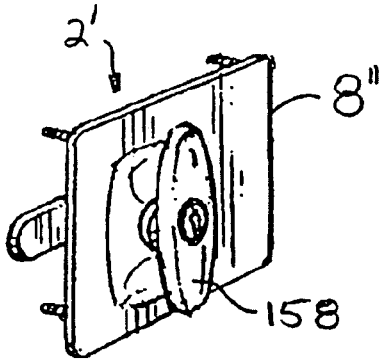
FIG. 18 is a perspective view of a first alternate locking T-handle assembly 2' having a T-handle 158.
Figure 19:
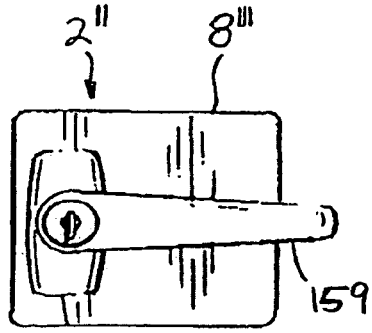
Figure 20:
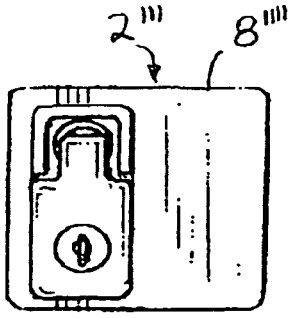
FIG. 20 is a front elevation of a keyed compression lock assembly 2''' having a mounting plate 8'''' generally the same as those shown in FIGS. 16-19.
Figure 21:
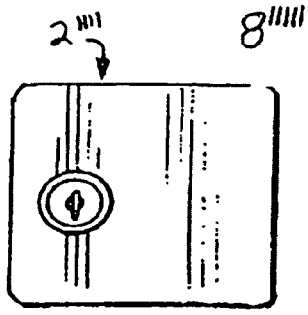
FIG. 21 is a front elevation of a keyed cam lock cylinder assembly 2'''' having a mounting plate 8''''' generally the same as the mounting plates shown in FIGS. 16-20.

Referring now also to FIGS. 11-14, the lock assembly 2 includes a lock bolt assembly 6 secured to an interior surface 107 of the front enclosure door 104. The enclosure 102 includes a rotary latch assembly 114. As shown in FIG. 12, the rotary latch assembly 114 includes a rotary latch 115 in both assembly 116 secured to an alternate mounting plate 8' and a door release 126 that is interconnected with the rotary latch 115 by an actuating cable 134. The rotary latch assembly is preferably an Eberhardt rotary latch assembly available from Eberhardt Manufacturing Company, Strongsville, Ohio 44149. The preferred door release 126 includes a pivoting release member 128 interconnected with an elongated wire 129 extending through the actuating cable 134. The wire 129 is interconnected with an actuating arm 139 of the rotary latch 115 and the actuating cable 134 is separately connected to a cable securing member 138 attached to a rotary latch mounting plate 136. The rotary latch 115 includes a U-shaped catch member 137 that rotates about a bolt 131 when the rotary latch actuating arm 139 is actuated. The bolt assembly 116 includes an L-shaped member 140 secured to the alternate mounting plate 8'. A bolt 142 is secured to the L-shaped member 140 and the bolt assembly 116 is secured to the rear or second enclosure door 106 in a manner similar to the way the electronic lock assembly 2 is secured to the front enclosure door 104. Referring now also to FIGS. 16 and 17, to secure the bolt assembly 116 to the rear enclosure door 106, the mounting plate 8' is secured within an opening 120 in the rear enclosure door. The pivoting catch 137 will receive the bolt 142 when the enclosure door 106 is pushed into a closed position as illustrated in FIG. 12. The cable 134 is secured to the door release 126 and the rotary latch mounting plate 136 in a manner which permits the release member 128 to place leverage upon the elongated wire when the release member 128 is pivoted upward as shown by the arrow in FIG. 14, thereby placing downward force on the rotary latch actuating arm 139 that will rotate the U-shaped catch member 137 to release the bolt 142 when the release member 128 is raised to actuate the rotary latch 115 and allow the rear enclosure door 106 to be opened when the bolt 142 is released by the pivoting U-shaped latch 137.

Figure 15:
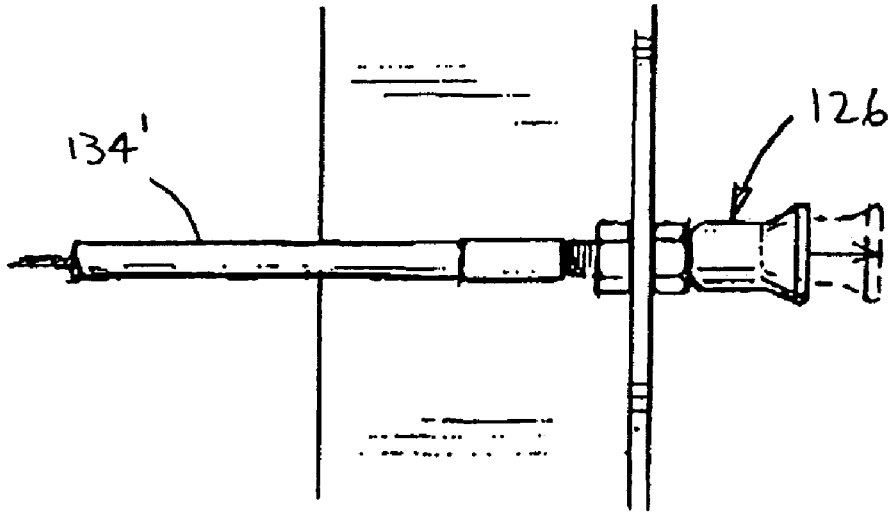
FIG. 15 is a side view of an alternate release 126' used in an alternate rotary latch assembly 126' (not shown) that is the same as the rotary latch assemble 126 shown in FIGS. 12 and 13, except for the alternate release 126'.

In alternate embodiments, an alternate door release 126' (see FIG. 15) may be used in connection with the rotary latch 115. It will be appreciated, however, that any commonly used door release may be used in the present invention and any commonly used latch mechanism may be employed to secure the rear door. Some of these various latches are disclosed herein below.

It will also be appreciated that the enclosure may have other types of securing mechanism associated with the rear door 106 in alternate embodiments. A number of these securing mechanisms are also disclosed below. In each case, however, the securing mechanism will include a mounting plate of the type described above so that the various securing mechanisms may be interchanged without significant difficulty.

It will be appreciated that an alternate bolt assembly (not shown) where an alternate universal or standard mounting plate to which a further L-shaped bracket is attached, can be secured to the left side of the enclosure 102 when facing the rear enclosure door 106. In this alternate embodiment (not shown), the L-shaped bracket is secured to the alternate mounting plate when turned the opposite direction from that shown in FIGS. 16 and 17, so that a further alternate universal mounting plate assembly (not shown) can be assembled for attachment to a right side of the enclosure 102 when facing the rear enclosure door 106.

The lock assemblies of the present inventions will preferably combine a mounting plate with components of each of the following types of latches, handles and locks:

Compression Latches such as:

Folding T Handle Compression Latch; Lift and Turn Flush Compression Latch; Lift and Turn Handle Compression Latch; Lever Compression Latch; Vise Action Compression Latch; and Multi-point Compression Latch and the like;

Handles such as:

Locking Pawl/Cam Action L-Handle; Non-Locking Pawl/Cam Action L-Handle; Locking L Handle; Non-Locking T Handle; Padlockable L Handle; Tool-Operated L Handle; Locking Push-Button L Handle; Non-Locking Push Button L Handle; D-Ring Handle; Locking D-Ring Handle; Grab Handle; Pull Handle; Finger Pull Handle; Pocket Pull Handle, Flush Mount; Concealed Pull Handle; Recessed Swing Handle; Quarter Turn Handle; Slam Action Handle and the like;

Pawl/Cam Action Latches such as:

Lever Quarter-Turn Latch; Quarter-Turn Latch; Key-Locking Quarter-Turn Latch; Wing Knob Quarter-Turn Latch Padlockable; Wing Knob Quarter-Turn Latch; 1-Point Door Latch; 2-Point Door Latch; 3-Point Door Latch; Rotary Latch; Push to Close Latch; Slam Action Latch and the like; and Locks such as: Cam Lock Cylinders and the like.

It will be appreciated that still other latches, handles and locks may be used to secure the enclosure door of the present inventions without departing from the broad general scope of the present invention.

Several of these securing mechanisms are shown in FIGS. 18-21.

It is to be understood that, even though numerous characteristics and advantages of various embodiments of the present invention have been set forth in the foregoing description, together with details of the structure and function of various embodiments of the invention, this disclosure is illustrative only, and changes may be made in detail, especially in matters of shape, size and arrangement of parts, within the broad principles of the present invention, to the full extent indicated by the broad general meaning of the terms in which the appended claims are expressed.

What is claimed is:

1. An enclosure suitable for restricting access to equipment stored within the enclosure, the enclosure comprising:

a plurality of sides;

an interior space defined in part by the plurality of sides; wherein at least one of the plurality of sides includes a first door and a first side opening through which the interior space is accessible when the first door is in a first open position, the first door having an interior side, an exterior side and a first lock assembly opening which is defined by a plurality of edges; wherein the plurality of edges interconnect with each other to fully surround the lock assembly opening; and a first lock assembly secured at least partially within the first lock assembly opening such that the first door can be secured in a second closed position, wherein access to the interior space via the first side opening is prevented by the first door when the first door is in the second closed position; the first lock assembly including:

a mounting plate having an interior surface and an exterior surface;

a lock actuation mechanism; and a securing mechanism secured proximate the interior surface of the mounting plate; wherein the lock actuation mechanism can actuate the securing mechanism so that the securing mechanism can prevent the first door from being opened when the first door is in the second closed position; wherein the interior surface of the mounting plate is secured against the exterior side of the first door proximate at least one of the edges of the first lock assembly opening so that the first lock assembly is effectively secured to the first door; wherein the mounting plate and the securing mechanism are on opposite sides of the first door.

2. The enclosure of claim 1, wherein a second one of the plurality of sides includes a second door and a second side opening through which the interior space is accessible when the second door is in a first open position, wherein the second door is secured in a second closed position by a latch and the second door can be opened when the second door is in the second closed position by actuating the latch from a position within the interior space so as to release the door so that the door can be opened and the interior space is accessible through the second side opening.

3. The enclosure of claim 2, further comprising a second mounting plate to which the latch is secured and a latch actuation mechanism interconnected with the latch; the second mounting plate having interior and exterior surfaces; wherein the second door has an interior side, an exterior side and a second lock assembly opening which is defined by a plurality of edges; wherein the plurality of edges interconnect with each other to fully surround the second lock assembly opening; wherein the latch actuation mechanism can actuate the latch so that the latch will release the second door when the second door is in the second closed position permitting access to the interior space through the second side opening; wherein the interior surface of the mounting plate is secured against the exterior side of the second door proximate at least one of the edges of the second lock assembly opening so that the latch is effectively secured to the second door; wherein the mounting plate and the latch are on opposite sides of the second door.

4. The enclosure of claim 1, wherein the first lock assembly is selected from the group consisting of a lock cylinder, an electronic lock, a quarter turn latch, a compression latch, a folding T latch, a lift and turn compression latch, a pawl/cam action latch, a multi-point latch system, and an actuated bolt for securing to a rotary latch that is secured to the enclosure.

5. The enclosure of claim 1, wherein the first lock assembly is easily exchanged with a second lock assembly by disengaging the first lock assembly from the lock assembly opening and inserting the second lock assembly in the lock assembly opening and securing the second lock assembly within the lock assembly opening of the first door; wherein the second lock assembly includes a second mounting plate having an interior surface; wherein the interior surface of the second mounting plate is attached to the exterior side of the first door and effectively grips at least one of the edges so that second lock assembly is effectively secured to the first door.

6. An enclosure suitable for restricting access to equipment stored within the enclosure, the enclosure comprising:

a plurality of sides; a frame including upright supports; an interior space defined in part by the plurality of sides; wherein one of the plurality of sides includes a first door and a first side opening through which the interior space is accessible when the first door is in a first open position, the first door having an interior side, an exterior side and a lock assembly opening which is defined by a plurality of edges; wherein the plurality of edges interconnect with each other to fully surround the first lock assembly opening; wherein a second side of the plurality of sides includes a second door and a second side opening through which the interior space is accessible when the second door is in a first open position;

a first lock assembly secured at least partially within the lock assembly opening such that the first door can be secured in a second closed position when access to the interior space via the first side opening is prevented by the first door; the first lock assembly including:

a mounting plate having an interior surface and an exterior surface;

a lock actuation mechanism; and a securing mechanism secured proximate the interior surface of the mounting plate; wherein the lock actuation mechanism can actuate the securing mechanism so that the securing mechanism can prevent the first door from being opened when the first door is in the second closed position; wherein the interior surface of the mounting plate is secured against the exterior side of the first door proximate at least one of the edges of the first lock assembly opening so that the first lock assembly is effectively secured to the first door; wherein the mounting plate and the securing mechanism are on opposite sides of the first door.

7. The enclosure of claim 6, wherein the second door includes an interior door release having a latch.

8. The enclosure of claim 7, wherein the latch is part of a latch assembly including a mounting plate and the latch is secured to the mounting plate.

9. The enclosure of claim 6, wherein a second one of the plurality of sides includes a second door and a second side opening through which the interior space is accessible when the second door is in a first open position, wherein the second door is secured in a second closed position by a latch and the second door can be opened when the second door is in the second closed position by actuating the latch from a position within the interior space so as to release the door so that the door can be opened and the interior space is accessible through the second side opening.

10. The enclosure of claim 9, wherein the second door has an interior side, an exterior side and a second lock assembly opening which is defined by a plurality of edges; wherein the plurality of edges interconnect with each other to fully surround the second lock assembly opening.

11. The enclosure of claim 6, wherein the first lock assembly is selected from the group consisting of a lock cylinder, an electronic lock, a quarter turn latch, a compression latch, a folding T latch, a lift and turn compression latch, a pawl/cam action latch, a multi-point latch system, and an actuated bolt for securing to a rotary latch that is secured to the enclosure.

12. The enclosure of claim 6, wherein the first lock assembly is easily exchanged with a second lock assembly by disengaging the first lock assembly from the lock assembly opening and inserting the second lock assembly in the lock assembly opening and securing the second lock assembly within the lock assembly opening of the first door; wherein the second lock assembly includes a second mounting plate having an interior surface; wherein the interior surface of the second mounting plate is attached to the exterior side of the first door and effectively grips at least one of the edges so that second lock assembly is effectively secured to the first door.

13. A method of accessing an interior space within an enclosure; the method comprising the steps of:

providing an enclosure suitable for restricting access to equipment stored within the enclosure, the enclosure including:

a plurality of sides;

an interior space defined in part by the plurality of sides; wherein at least one of the plurality of sides includes a first door and a first side opening through which the interior space is accessible when the first door is in a first open position, the first door having an interior side, an exterior side and a first lock assembly opening which is defined by a plurality of edges; wherein the plurality of edges interconnect with each other to fully surround the lock assembly opening; and a first lock assembly secured at least partially within the first lock assembly opening such that the first door can be secured in a second closed position, wherein access to the interior space via the first side opening is prevented by the first door when the first door is in the second closed position; the first lock assembly including:

a mounting plate having an interior surface and an exterior surface;

a lock actuation mechanism; and a securing mechanism secured proximate the interior surface of the mounting plate; wherein the lock actuation mechanism can actuate the securing mechanism so that the securing mechanism can prevent the first door from being opened when the first door is in the second closed position; wherein the interior surface of the mounting plate is secured against the exterior side of the first door proximate at least one of the edges of the first lock assembly opening so that the first lock assembly is effectively secured to the first door; wherein the mounting plate and the securing mechanism are on opposite sides of the first door; wherein a second side of the plurality of sides includes a second door and a second side opening through which the interior space is accessible when the second door is in a first open position and the second door includes an interior door release having a latch;

opening the first door to gain access to the interior space; and actuating the latch to release the second door so that access to the interior spaces is possible through the second side opening.

14. The method of claim 13, further comprising the steps of:

disengaging the first lock assembly from the opening;

inserting a second lock assembly into the opening; wherein the second lock assembly includes:

a securing mechanism, a lock actuating mechanism and a mounting plate having an interior surface and an exterior surface the lock mechanism being secured to the mounting plate; and securing the second lock assembly at least partially within the opening so that the second lock assembly is operatively secured to the first enclosure door.

15. The method of claim 14, wherein the second lock assembly is selected from the group consisting of a lock cylinder, an electronic lock, a quarter turn latch, a compression latch, a folding T latch, a lift and turn compression latch, a pawl/cam action latch, a multi-point latch system, and an actuated bolt for securing to a rotary latch that is secured to the enclosure.

16. The method of claim 13, wherein the first lock assembly is selected from the group consisting of a lock cylinder, an electronic lock, a quarter turn latch, a compression latch, a folding T latch, a lift and turn compression latch, a pawl/cam action latch, a multi-point latch system, and an actuated bolt for securing to a rotary latch that is secured to the enclosure.

17. A method of securing a securing mechanism to a door of an enclosure suitable for restricting access to equipment stored within the enclosure so that the securing mechanism is easily disengaged from the door, the method comprising the steps of:

providing an enclosure including: a plurality of sides; an interior space defined in part by the plurality of sides; wherein at least one of the plurality of sides includes a first door and a first side opening through which the interior space is accessible when the first door is in a first open position, the first door having an interior side, an exterior side and a lock assembly opening that is defined by a plurality of edges; wherein the plurality of edges interconnect with each other to fully surround the lock assembly opening; providing a first lock assembly; the first lock assembly including: a mounting plate having an interior surface and an exterior surface; a lock actuation mechanism; and a securing mechanism secured proximate the interior surface of the mounting plate; wherein the lock actuation mechanism can actuate the securing mechanism so that the securing mechanism can prevent the first door from being opened when the first lock assembly is secured to the first door and the first door is secured in a second closed position;

securing the first lock assembly to the first door such that first lock assembly is secured at least partially within the first lock assembly opening such that the first door can be secured in a second closed position, wherein access to the interior space through the first side opening is prevented by the first door when the first door is in the second closed position; wherein the interior surface of the mounting plate is secured against the exterior side of the first door proximate at least one of the edges of the first lock assembly opening so that the first lock assembly is effectively secured to the first door; wherein the mounting plate and the securing mechanism are generally located on opposite sides of the first door.

18. The method of claim 17, further comprising the steps of:

disengaging the first lock assembly from the first door; providing a second lock assembly; the second lock assembly including: a second mounting plate having an interior surface and an exterior surface; a second lock actuation mechanism; and a second securing mechanism secured proximate the interior surface of the second mounting plate; wherein the second lock actuation mechanism can actuate the second securing mechanism so that the securing mechanism can prevent the first door from being opened when the second lock assembly is secured to the first door and the first door is secured in a second closed position; and securing the second lock assembly to the first door such that second lock assembly is secured at least partially within the second lock assembly opening such that the first door can be secured in a second closed position, wherein access to the interior space through the first side opening is prevented by the first door when the first door is in the second closed position; wherein the interior surface of the second mounting plate is secured against the exterior side of the first door proximate at least one of the edges of the first lock assembly opening so that the second lock assembly is effectively secured to the first door; wherein the second mounting plate and the second securing mechanism are generally located on opposite sides of the first door.

* * * * *